United States Patent [19]

Phelps

[11] 4,187,922

[45] Feb. 12, 1980

[54] VARIED PITCH ROTARY ROCK BIT

[75] Inventor: Francis E. Phelps, Dallas, Tex.

[73] Assignee: Dresser Industries, Inc., Dallas, Tex.

[21] Appl. No.: 905,256

[22] Filed: May 12, 1978

[51] Int. Cl.[2] ..... E21C 13/02

[52] U.S. Cl. ..... 175/374; 175/376; 175/378; 175/410

[58] Field of Search ..... 175/374, 376, 378, 410, 175/343; 404/121; 74/437

[56] References Cited

U.S. PATENT DOCUMENTS

| | | | |
|---|---|---|---|
| 1,896,251 | 2/1933 | Scott | 175/378 |
| 2,626,128 | 1/1953 | Boke | 175/376 X |
| 3,429,390 | 2/1969 | Bennett | 175/343 |
| 3,955,635 | 5/1976 | Skidmore | 175/410 X |
| 4,096,917 | 6/1978 | Harris | 175/343 X |

*Primary Examiner*—Ernest R. Purser

*Assistant Examiner*—Nick A. Nichols, Jr.

*Attorney, Agent, or Firm*—Eddie E. Scott

[57] ABSTRACT

A rotary rock bit is constructed having rolling cutter members for forming a borehole in the earth. Each rolling cutter member includes an annular row of cutting elements for cutting portions of the borehole. The cutting elements comprise cutting teeth or cutting inserts. Varied pitches are provided between the inserts/-teeth. The pitches between pairs of inserts/teeth are varied so that the pitches between no two pairs of inserts/teeth in a row or group are the same. Since no two pairs of inserts/teeth have the same pitch, the probability of tracking will be remote. This increases the rate at which the bit penetrates the formation and generally decreases the probability of insert/tooth breakage therein. The present invention reduces or eliminates tracking and stumbling encountered in prior art earth boring bits.

10 Claims, 3 Drawing Figures

VARIED PITCH ROTARY ROCK BIT

BACKGROUND OF THE INVENTION

The present invention relates to the art of earth boring and, more particularly, to a rolling cutter rotary rock bit having varied pitches between the teeth or inserts of the bit.

The rapidly increasing demand for the earth's natural resources such as oil and gas and various types of ores extracted by the mining industry has created the need for improved drilling bits. Rotary rock bits of the type embodying the present invention are adapted to be connected as the lowest member of a rotary drill string. As the drill string is rotated, the bit disintegrates the earth formations to form an earth borehole. Drill bit cutter life and efficiency are of prime importance in the drilling of such boreholes since the penetration rate is related to the condition of the bit and the operational efficiency.

Traditionally, rolling cutter rotary rock bits have three individual arms that extend angularly downward from the main body of the bit. The lower end of each arm is shaped to form a spindle or bearing pin. A rolling cone cutter is mounted upon each bearing pin and adapted to rotate thereon. Each of the cutters includes spaced circumferential rows of teeth or inserts offset in relation to the corresponding rows on the other cutters to drill the earth formations at the bottom of the borehole. The portions of the earth formations broken up by the cutting structure are removed from the borehole by a flushing drilling fluid such as drilling mud or air. Rolling cone cutter rotary rock bits in general can be categorized in two general classes. The first is tooth bits having generally chisel-shaped teeth integral with the body of the cone cutter. The second is insert or compact bits wherein individual inserts or compacts are press-fitted into holes in the cone body. The head of the insert projects from the cone cutter body and acts to break up the earth formations at the bottom of the borehole. The present invention can be employed in both classes of bits.

A rolling cutter rotary rock bit is designed so that the gage row inserts/teeth on the cutter determines the revolutions of the cutter with respect to revolutions of the bit. If the cutter was completely true rolling, the revolutions of the cutter would be equal to the circumference of the hole divided by the circumference of the cutter at the gage tip times the revolutions of the bit. The cutter would turn approximately 1.7 times the revolutions of the bit. However, the cutters are not designed for true rolling and the surface of the cutters have projecting inserts/teeth. The cutters will turn approximately 1.2 to 1.5 times the revolutions of the bit. The difference between true rolling revolutions and actual revolution of the cutter is the slippage or action on bottom.

Prior art bits have been restricted in their performance because of "tracking" and "stumbling." During the rotation of the rock bit each cone is "driven" by a row of heel (outer) inserts/teeth meshing with impressions which are cut into the bottom of the borehole by the combined heel inserts/teeth of all three cone cutters. When the relationship of the heel inserts/teeth on an individual cone cutter with respect to the combined heel impressions on the bottom of the hole is such that an inner row of inserts/teeth falls into its own previous impressions, tracking exists. Since an insert or tooth cannot dig effectively by hitting in its previous impressions, tracking is to be avoided. Stumbling is related to tracking in that the driving teeth on a cone cutter strike upon the flanks of rock teeth impressions previously laid down by the combined heel teeth pattern and skid, slide or "stumble" into the rock teeth impressions. The cause appears to be insufficient spread in the pitches of driving teeth numbers.

The "pitch" between rock bit inserts/teeth, refers to the measured, straight line, distance between centerlines, at the tips, of adjacent inserts/teeth. The pitch between inserts/teeth is useful in comparing different designs because a given pitch may cut satisfactorily in a formation of a certain hardness and/or abrasiveness and not cut satisfactorily in a formation of a different hardness. Also, pitches trend from wide to narrow as the design of bits trends from soft to hard formations. Within a given type bit, pitches trend with diameter of bits and diameter of inserts/teeth; i.e., a larger bit usually requires larger inserts/teeth diameters and lengths; and, consequently, due to required clearances between larger inserts/teeth, larger pitches are necessary. "Pitches" sometimes cause problems which are related to tracking and/or stumbling.

A cutter having evenly spaced inserts/teeth with wide pitch will cut a basic pattern in the bottom of the hole. The portion of the rock or formation between the cuts in the bottom are called rock teeth. With one cutter on the bit, these rock teeth will increase in size because the inserts/teeth on the cutter will try to fall or gear to the bottom. If the cutter was rolling true, it would gear to bottom and the bit would not drill. This condition is tracking. Since the cutter does not roll true, the inserts/teeth will not fall in track and the rock teeth will be removed. By having one row of inserts/teeth on each cutter, cutting the same track at the outer part of the hole, the rock teeth are removed or reduced in size; therefore, the bit will drill ahead. With two cutters and a smaller pitch between the gage inserts/teeth will try to fall in track with the coarse rock teeth.

Another problem encountered with prior art bits is inner row dominance. On occasion, due to combination of inserts/teeth numbers, instead of the outermost rows of inserts/teeth setting the driving pattern, an inner row, usually the second or third row from the hole wall, dominates the pattern and sets the driving pattern for that particular cone cutter. This driving pattern causes the outermost row of inserts/teeth to run in an abnormal pattern which exerts forces laterally upon the inserts/teeth and tends to cause breakage of inserts/teeth. The present invention tends to prevent inner row dominance and helps prevent outer row breakage.

DESCRIPTION OF PRIOR ART

In U.S. Pat. No. 3,727,705 to Elmer F. Newman patented Apr. 17, 1973, a drill bit with improved gage compact arrangement is shown. A drill bit is disclosed as having a gage compact arrangement by which the resistance to gage wear is increased, gage wear is balanced and the tendency toward off-center wear is decreased. The heel row compacts on each cone generally are equally spaced. However, the spacing between the heel row compacts differs from cone to cone to prevent tracking of the compacts in impressions previously made on the borehole bottom. The cross-sectional dimension of the gage compacts that project from and protect the gage surface of each cone is different from cone to cone. As a consequence, the total exposed area of all the gage compacts of one cone approaches the total exposed area of all the gage compacts of each of the other cones.

In U.S. Pat. No. 3,726,350 to Rudolph Carl Otto Peissier patented Apr. 10, 1973, an anti-tracking earth boring drill is shown. In an earth boring drill, a cutter is disclosed with cutting teeth arranged to engage a selected annular area of the borehole bottom in a non-tracking and cutter shell erosion preventing manner during bit rotation. The spacing of the teeth in different circumferential rows of the cutter is changed to maintain an optimum distance between the teeth. Further, the teeth are arranged in groups of interrupted spacing, and interruption teeth are used selectively to arrange the pattern of teeth to prevent tracking and cutter shell erosion.

In U.S. Pat. No. 3,126,973 to Othar M. Kiel patented Mar. 31, 1964, a rotary drilling bit is shown. The circumferential rows of teeth formed on the cutters are spaced apart and are often offset relative to the rows on adjacent cutters so as not to interfere with the rotation of the cones, and to make substantially complete contact with the bottom of a well. The cones are non-circular and capable of imparting a vibratory effect to the drill bit and thereby increases penetration efficiency. The outer row of teeth define a non-circular periphery and the inner row of teeth define a circular periphery. The outer rows provide a vibrating effect on the drill bit as it is rotated against the earth while the inner rows serve to stabilize and maintain the drill bit on a straight drilling path.

In U.S. Pat. No. 2,994,390 to Alexander B. Hildenbrandt patented Aug. 1, 1976, a rock bit cutter is shown. A conical cutter element, the wall surface of which is provided with a plurality of ridges is shown. The ridges on each cutter element are substantially parallel to the base portion of the element and extend halfway around the periphery of the element. Adjacent ridges are spaced from each other a distance approximately equal to one-half the height of each ridge. Adjacent ridges extend around opposite semi-peripheries of each element, so that the beginning of one ridge falls between the ends of adjacent ridges. Thus, the individual ridges are in effect staggered and therefore track between the paths that are taken by the next adjacent ridges on each side.

In U.S. Pat. No. 2,533,260 to Henry B. Woods patented Dec. 12, 1950, a rotary drill bit and cutter therefor is shown. Cutters are provided having substantially uniform cross-section throughout their depth, such elements terminating at their outer ends in elemental teeth so that the initial cutting rate is high during the wearing away of such teeth, the inner portions of such elements being adapted to produce efficient cutting action as the elemental teeth have been worn away and until the cutting elements are entirely destroyed. A set of cutters is shown having segmental cutting elements spaced circumferentially of the cutter bodies and staggered along such bodies in a manner that the cutting elements of adjacent cutters interfit with at least some of such elements being provided with elemental teeth on their crest. Elements supplementing and cooperating with an outer row of heel teeth assure rotation of the cutter.

In U.S. Pat. No. 2,533,259 to Henry B. Woods and Floyd L. Scott patented Dec. 12, 1950, a cluster tooth cutter is shown. A rotary cutter drill bit is provided wherein the spacing of certain successive teeth thereon approximates the sum of the spacing of the remaining teeth. A rock cutter is provided with teeth which are arranged in clusters in circumferential rows with adjacent teeth in each cluster having a relatively small pitch so that the rock gear formed on bottom will likewise be of small pitch and hence readily disintegrated by the cutting action of the cutter. A cluster of teeth are provided which are such a pitch relative to each other that the combined pitches of all the clustered teeth is less than the span of the blank space on the cutter between the ends of the cluster of teeth.

In U.S. Pat. No. 2,533,258 to Erwin A. Moreland and Henry B. Woods patented Dec. 12, 1950, a drill cutter is shown. A circular, flat-crested cutting element is provided for the cone-shaped cutters, the crest area of which will not rapidly increase as the cutting element wears, so that the bit will maintain a desirable rate of penetration throughout the life of the cutters without necessity of unduly increasing applied weight. An outer row of longitudinal teeth in combination with a plurality of inner, circumferential rows of flat-crested cutting elements is provided. The said outer row or rows assist in the rotation of the cutters. A set of generally cone-shaped cutters having strong, segmental, flat-crested, circumferentially arranged cutting elements spaced longitudinally of one of said cutters is provided. The sum of the crest links of the segments in any row are less than the full circumference of said row, so that lower initial weight will be required to make said cutting elements penetrate the formation for more rapid excavation of the material to be drilled. A set of generally cone-shaped cutters having segmental, flat-crested, circumferentially extending cutting elements spaced longitudinally of said cutters is provided, with said elements on adjacent rows staggered longitudinally, while the cutting elements on each of said cutters are staggered circumferentially so that as the cutters rotate, the weights will not only be better distributed around each cutter as it rolls on the well bottom, but said weight will be more evenly distributed between companion cutters of the set for better traction and prevention of intermittent overloading.

SUMMARY OF THE INVENTION

The present invention provides an improved rolling cutter earth boring bit. A rotary rock bit is constructed having at least one rolling cutter member for forming a borehole in the earth. The rolling cutter member includes at least one annular row of cutting elements in the cutter member for cutting portions of the borehole. Varied pitches are provided between the inserts/teeth of the cutter. In a preferred embodiment of the invention, the pitches between pairs of inserts/teeth are varied so that the pitches between no two pairs of inserts/-teeth in a row or group are the same. Since no two pair of inserts/teeth have the same pitch, the probability of tracking will be remote. This increases the rate at which the bit penetrates the formation and generally decreases the probability of insert/tooth breakage therein. The present invention reduces or eliminates tracking and stumbling encountered in prior art earth boring bits. The above and other features and advantages of the present invention will become apparent from a consideration of the following detailed description of the invention when taken in conjunction with the accompanying drawings.

DETAILED DESCRIPTION OF THE INVENTION

Figure 1:
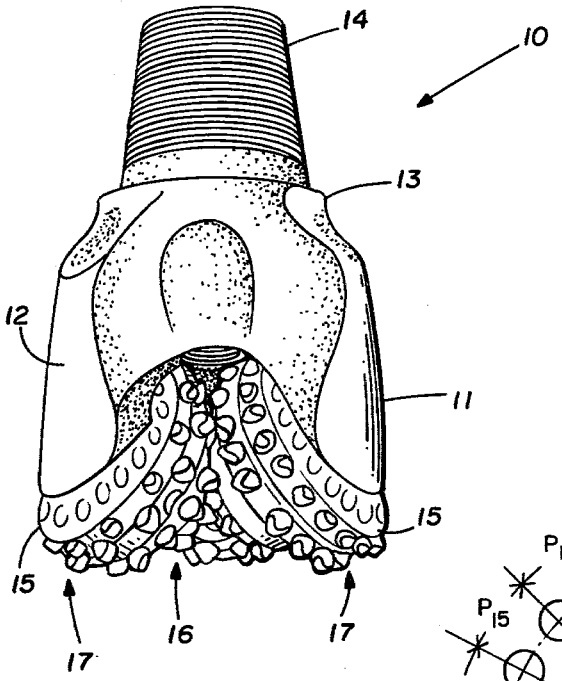
FIG. 1 is a perspective view of an earth boring bit constructed in accordance with the present invention.

Referring now to the drawings, and to FIG. 1 in particular, a rotary rock bit generally designated by the reference character 10 embodying the present invention is illustrated. The bit 10 includes a bit body 13 adapted to be connected at its pin end 14 to the lower end of a rotary drill string (not shown). The bit body 13 includes an internal passage system providing communication for drilling fluids such as drilling muds or the like passing downwardly through the drill string to allow the drilling fluid to be directed to the bottom of the well bore. The drilling fluid passes upwardly in the annulus between the wall of the borehole and the drill pipe carrying the cuttings and drilling debris therewith.

Depending from the body of the bit are three substantially identical arms. Arms 11 and 12 are shown in FIG. 1. The lower end portion of each of the arms is provided with a bearing pin. Each arm rotatably supports a generally conical cutter member 15. The bearing pin carrying the cutting members 15 define axes of rotation about which the cutter members 15 rotate. The axes of rotation are tilted downwardly and inwardly at an angle.

Each of the cutter members 15 include a nose portion 16 that is oriented toward the bit axis of rotation and a base 17 that is positioned at the intersection between the wall and the bottom of the borehole. Each of the cutter members 15 includes an annular row of heel inserts or teeth located adjacent the base of each cutting member. The row of heel inserts/teeth cut the intersection between the borehole wall and the bottom of the borehole. Each of the cutter members 15 also include at least one annular inner row of inserts or teeth for destroying the inner portion of the borehole. The teeth are milled on the cutter member whereas the inserts are mounted in sockets bored in the cutter member.

Figure 2:
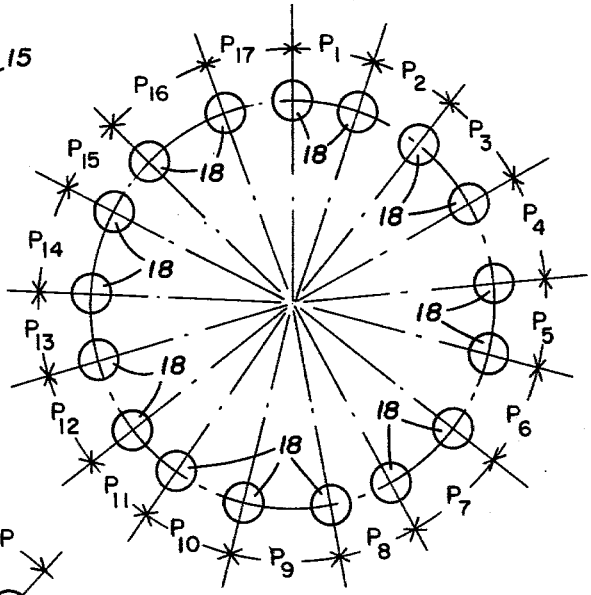
FIG. 2 is a schematic layout illustrating a preferred cutter insert/tooth spacing arrangement.

Referring now to FIG. 2, an insert/tooth spacing pattern for a row of inserts/teeth of a rolling cone rotary rock bit constructed in accordance with the present invention is illustrated. This insert/tooth spacing pattern represents the pattern for one row of the inserts/teeth of a rolling cone rotary rock bit such as a bit 10 shown in FIG. 1. This row includes seventeen (17) individual inserts/teeth 18. The normal angular pitch would be calculated by dividing 360° by 17 or would be equal to 21.176° if the inserts/teeth were positioned equally. The present invention utilizes a version of skip drilling/milling to break up the pattern laid down by the previous revolution of the bit. No two pitches are the same and are arranged at a random. Since no two pairs of inserts/teeth have the same pitch, the probability of tracking will be remote. This increases the rate at which the bit penetrates the formation and greatly decreases the probability of insert/tooth breakage due to tracking. The spacing between the inserts/teeth is obtained using a random number table or generator to assign each successive pitch a position. The following table shows the angular pitch of the inserts/teeth 18 of the tooth spacing pattern shown in FIG. 2.

Table (FIG. 2)

| Pitch | Angular Pitch | Pitch | Angular Pitch |
|---|---|---|---|
| $P_1$ | 18.47° | $P_9$ | 25.26° |
| $P_2$ | 20.10° | $P_{10}$ | 21.19° |
| $P_3$ | 22.28° | $P_{11}$ | 16.84° |
| $P_4$ | 23.91° | $P_{12}$ | 21.74° |
| $P_5$ | 20.65° | $P_{13}$ | 19.02° |
| $P_6$ | 22.83° | $P_{14}$ | 24.46° |
| $P_7$ | 23.83° | $P_{15}$ | 17.38° |
| $P_8$ | 17.93° | $P_{16}$ | 25.00° |
| | | $P_{17}$ | 19.56° |

The random spacing of inserts or teeth on the inner rows reduces the size of the rock teeth cut by these rows and result in an increased penetration. It eliminates the chance of a rock bit tracking and will assist the bit in drilling ahead. This type of milling will keep any inner row from driving the cutter or determining the RPM of the cutter which would break or wear the gage teeth off. This also increases the penetration rate and cutting structure life. The random placing of teeth or inserts on the cutter should cause the bit to cut the bottom clean with the smallest rock teeth possible, and results in an overall increase in penetration rate.

The random placing of teeth or inserts on a cutter is difficult. The milling the teeth or drilling the holes for inserts must be closely controlled. With the availability of tape control machining, this type of milling or drilling is possible. With a random placement of teeth or inserts, no two adjacent teeth or inserts will have the same pitch between them. The pitch between them could vary from the basic pitch of one inch as follows: 1" pitch, 15/16" pitch, ⅞" pitch, 1 1/16" pitch and 1⅛" pitch. This would provide a pattern of six teeth. If the cutterhead had 18 teeth, three such patterns on the row of teeth would be provided. The placement could be in groups of any number of teeth or could vary all the way around the cutter. With this type of spacing on all three cutters, the teeth would not track or gear to the rock teeth on bottom. This reduces the size of the rock teeth and therefore increases the penetration rate. The random spacing overcomes the tendency for the teeth to fall back into track as with a skip milling method.

If the teeth were placed on the cutter with even pitch between them except for two places with a pitch equal to 1½ times the basic pitch, called skipped milling, it would throw the teeth out of track every time one of the wide pitches passed the bottom of the hole. This type of milling or tooth pattern reduces the rock tooth build-up more and increases the penetration rate. If a cutter had two groups of teeth with the wide pitch between them, and more than four teeth in a group, the teeth would have a tendency to fall back in track and cause wear on both sides of the tooth. This wear would reduce the life of the cutting structure. If the teeth were placed in groups of four, on a cutter with 16 teeth, four wide pitches would be provided. This would cause the bit to run rough and cause tooth breakage. The skip milling method limits the number of teeth that can be put on a cutter or, if the group has more than four teeth, it would fall back into the track. This type of milling or insert placement is used in the prior art to help remove the rock teeth. The skip milling can be put on one cutter, two cutters, or all three cutters.

Figure 3:
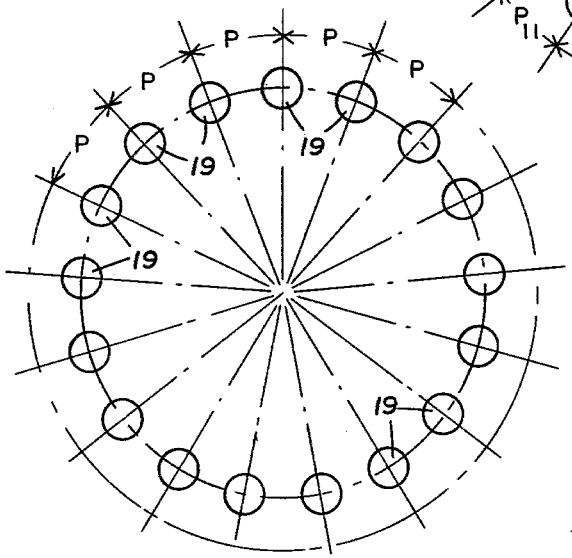
FIG. 3 PRIOR ART
FIG. 3 is a schematic layout illustrating a prior art cutter insert/tooth spacing arrangement.

Referring now to FIG. 3, an insert/tooth spacing pattern of a prior art rotary cone rock bit is illustrated. As shown in FIG. 3, the prior art spacing is equal. The pitches P between the inserts 19 are all the same. Earth formations material is not penetrated at optimum rates with this type of spacing because the rock bit inserts/-teeth track in previously formed impressions and break, wear heavily, or fail to cut new impressions. This type of bit is subject to both the "tracking" and "stumbling" problems previously discussed.

The embodiments of the invention in which an exclusive property or privilege is claimed are defined as follows:

1. A method of constructing a rotary rock bit having a bearing pin and at least one rolling cutter member rotatably mounted on said bearing pin for forming a borehole in the earth, said rolling cutter member having at least one annular row of cutting elements on the cutter member for cutting portions of the borehole, comprising the steps of:

providing at least one annular row of cutting elements encircling said cutter member for cutting portions of the borehole with spaces between adjacent cutting elements, and positioning said cutting elements on said cutter member in said annular row so that substantially all of said spaces between adjacent cutting elements are unequal.

2. A method of constructing a rolling cone rotary rock bit having three rolling cone cutters rotatably mounted upon individual bearing pins for forming a borehole in the earth, said rolling cone cutters having annular rows of cutting elements for cutting portions of the borehole, comprising the steps of:

providing annular rows of cutting elements encircling said rolling cone cutters for cutting portions of the borehole, and randomly spacing said cutting elements on said rolling cone cutters in at least one of said annular rows so that the spacing between substantially all adjacent cutting elements in said annular row is substantially unequal.

3. A method of constructing an earth boring bit having a rolling cutter rotatably mounted upon a bearing pin for forming an earth borehole in earth formations, said rolling cutter having at least one annular row of hard inserts mounted in sockets in the rolling cutter, comprising the steps of:

providing an annular row of sockets encircling said rolling cutter by boring said sockets in said rolling cutter;

boring said sockets in said rolling cutter member so that the spacing between substantially all adjacent sockets in said annular row are substantially unequal; and mounting said hard inserts in said sockets.

4. In a rotary rock bit having at least one rolling cutter member rotatably mounted upon a bearing pin for forming a borehole in the earth, said rolling cutter member having at least one annular row of cutting elements in the cutter member for cutting portions of the borehole, the improvement comprising:

an annular row of cutting elements encircling said cutter member for cutting portions of the borehole with substantially all of said cutting elements being randomly spaced so that said cutting elements are substantially unequally spaced from each adjacent cutting element in said annular row.

5. A drill bit, comprising:

a bit body adapted to be connected to a rotary drill string;

a bearing pin extending from said bit body;

a cone cutter rotatably mounted on said bearing pin;

an annular row of cutting elements encircling said cone cutter defining a row of heel cutting elements; and at least one annular row of inner cutting elements encircling said cone cutter with spaces between adjacent inner cutting elements, substantially all of said spaces between adjacent inner cutting elements being unequal.

6. In a rotary rock bit having at least one rolling cutter member rotatably mounted upon a bearing pin for forming a borehole in the earth, said rolling cutter member having at least one annular row of inserts mounted in sockets in the cutter member for cutting portions of the borehole, the improvement comprising:

an annular row of sockets encircling said cutter member with spaces between adjacent sockets, substantially all of said spaces between adjacent sockets being unequal, and inserts mounted in said sockets for cutting portions of the borehole.

7. In an earth boring bit having a rolling cone cutter rotatably mounted upon a bearing pin for forming an earth borehole by disintegrating earth formations, said rolling cutter having a nose and a cone base with at least one inner annular row of inserts between said nose and said base mounted in sockets in the rolling cone cutter, the improvement comprising:

an annular row of sockets encircling said cutter member between said nose and said base, and inserts mounted in said sockets with spaces between adjacent sockets and inserts, substantially all of said spaces being unequal.

8. A conical cutter adapted to be rotatably mounted upon a bearing pin of a rotary drill bit, comprising:

a conical body, a row of heel cutting elements encircling said conical body, at least one circumferential row of inner cutting elements encircling said conical body spaced longitudinally along the peripheral surface on said conical body inwardly from said row of heel cutting elements, said circumferential row consisting of inner cutting elements with spaces between adjacent inner cutting elements, substantially all of said spaces between adjacent inner cutting elements being unequally spaced so that said inner cutting elements effect cutting and reduce or eliminate tracking and stumbling.

9. In a drill bit having a plurality of approximately conical-shaped roller cutters mounted upon bearing pins and adapted to roll upon the well bottom, said cutters having a heel and individual cutting elements on each of said cutters with said cutting elements arranged in annular rows encircling the cutters inwardly from the heel, the spacing between substantially all adjacent cutting elements in said rows being substantially unequal.

10. A rolling cone rotary rock bit, comprising:

a bit body;

three bearing pins extending from said bit body; and three rolling cutters rotatably mounted on said bearing pins, each of said cutters comprising a substantially conical-shaped cutter shell, truncated to form a nose and a heel with intermediate rows of cutting elements encircling said cutter shell spaced longitudinally along the peripheral surface on said cutter shell inwardly from said heel, each of said intermediate rows consisting of cutting elements with spaces between adjacent cutting elements, substantially all of said spaces between adjacent cutting elements being unequal so that said cutting elements of each row effect cutting and reduce or eliminate tracking and stumbling.

* * * * *